United States Patent [19]

Emery

[11] Patent Number: 4,875,854

[45] Date of Patent: Oct. 24, 1989

[54] MINIATURE FORGE

[76] Inventor: Leslie M. Emery, 1901 SW. Childs Rd., Lake Oswego, Oreg. 97034

[21] Appl. No.: 171,763

[22] Filed: Mar. 22, 1988

[51] Int. Cl.[4] ..... F24J 3/00

[52] U.S. Cl. ..... 432/120; 110/195; 126/226; 432/231; 432/159

[58] Field of Search ..... 126/226, 229, 231, 240, 126/230; 432/120, 194, 231, 247, 252, 159; 110/195; 431/189

[56] References Cited

U.S. PATENT DOCUMENTS 4,424,025 1/1984 Jones ..... 110/195 X
4,424,795 1/1984 Plessner ..... 126/237
4,545,361 10/1985 Schantz et al. ..... 126/226
4,576,574 3/1986 Schantz ..... 126/226

FOREIGN PATENT DOCUMENTS 9965 of 1908 United Kingdom ..... 126/233

*Primary Examiner*—L. Randall Green
*Attorney, Agent, or Firm*—Lyon & Lyon

[57] ABSTRACT

A miniaturized forge consisting of a metal body with slots and openings to admit the metal to be heated, along with a bracket for holding a separate fuel tank containing a torch which extends vertically downward through a hole in the metal body. The torch within the forge is able to selectively heat areas of metal objects to a temperature high enough to allow them to be bent into a desired shape.

7 Claims, 2 Drawing Sheets

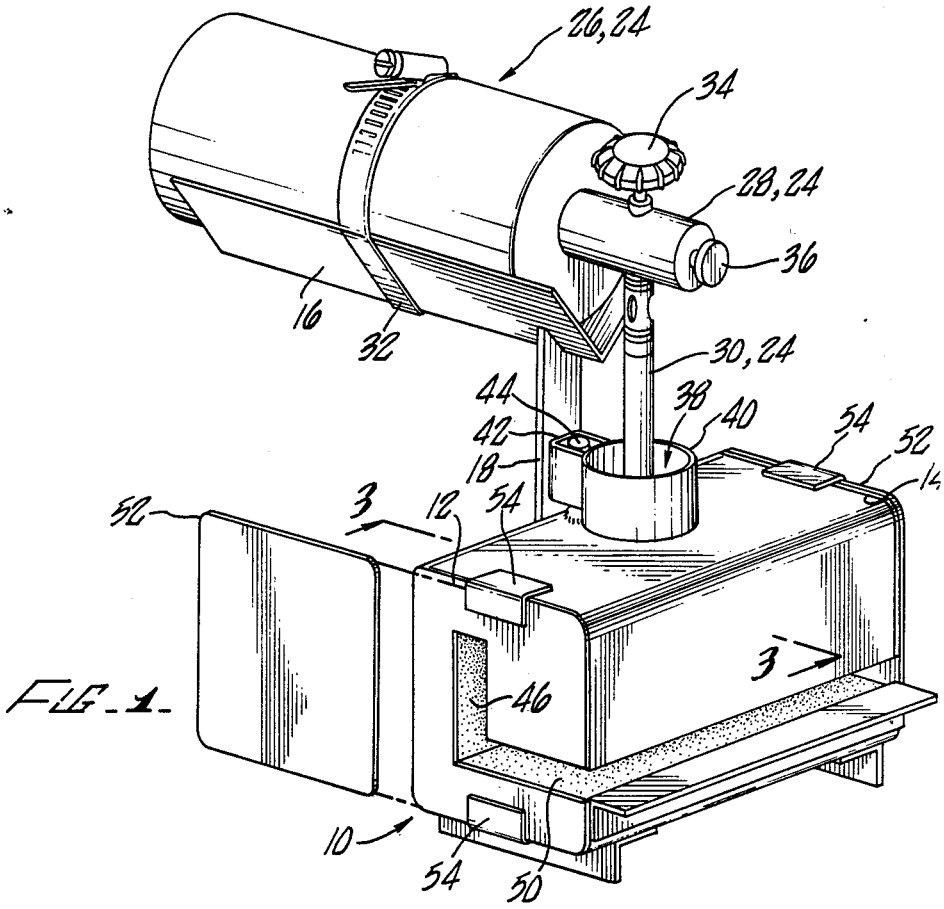
FIG. 1.
FIG. 4.
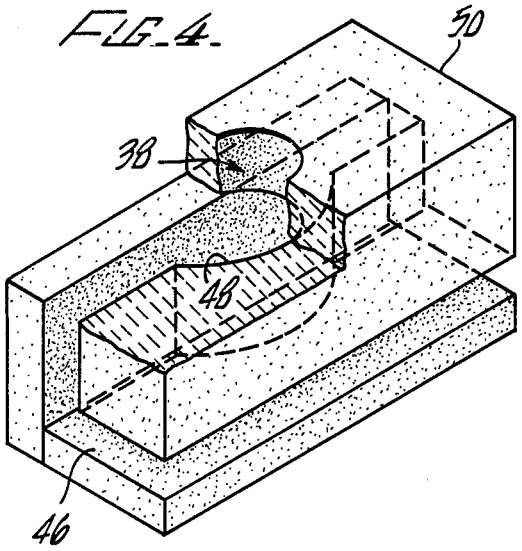
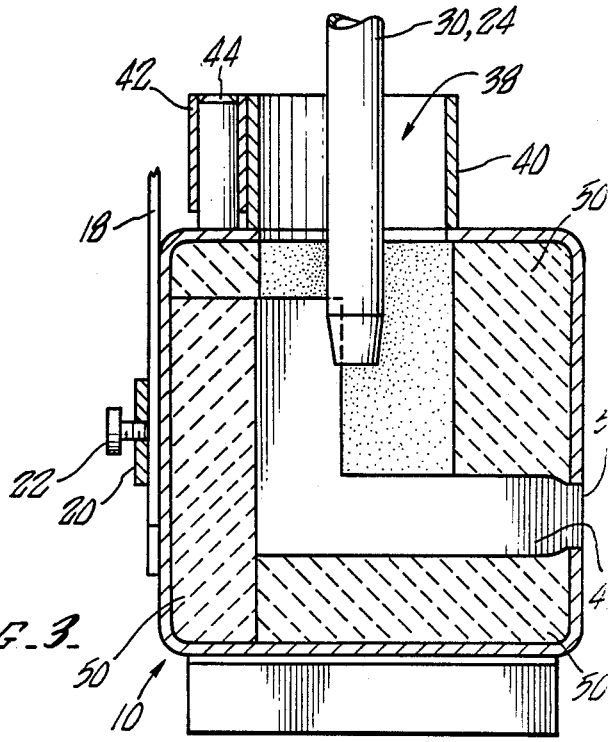
FIG. 3.

MINIATURE FORGE

BACKGROUND OF THE INVENTION

The field of the present invention is gas-fired forges used for heating metals for farriery use.

Gas-fired forges have been used for heating and shaping steel rod, tube, flat bar, angle iron, channel and sheet. They are generally designed to heat either the entirety of an object or an indiscriminately large area of it. Spot heating is typically done with a hand-held torch which burns either oxygen/acetylene or propane gas and only allows for heating a very small area to working temperature, unless using a very large torch and high volume of gas. Constant movement of the hand-held torch is required to spread heat beyond the square inch or so of its flame tip. Forges which heat entire objects also suffer from a lack of portability and cannot be moved easily from workstation to workstation.

SUMMARY OF THE INVENTION

The present invention is directed to a miniaturized forge for farriery uses, in which an appropriately-sized area of metal can be effectively heated in the field in order to accomplish the desired shaping. The forge consists of a metal body with slots and openings to admit the metal to be heated and shaped. It also contains a bracket which can hold a separate fuel tank and accompanying torch which is directed vertically downward into the interior of the forge through a hole in the top of the body. The heat from the torch is focused by adjusting the height of the torch as it passes through a collar surrounding the hole in the body. The interior consists of an insulated, refractory-lined curved cavity which also assists in focusing the heat of the torch over an area measuring $3'' \times 1\frac{1}{2}''$.

It is an object of the present invention to provide the advantages of selective spot-heating with the heating power of a focused-heat forge in selectively heating and shaping steel rod, tube, flat bar, angle iron, channel and sheet. The miniature forge accomplishes this by heating an optimum-sized area of the object to be shaped, which allows certain areas to be bent and shaped without affecting those areas which do not need reshaping.

It is a further object of the invention to aid the convenience of the iron worker by allowing him to spot-heat accurately in the field, in close proximity to any equipment he may be using to bend, twist or hammer, leaving both hands free to position the area to be spot-heated.

It is still a further object of the invention to allow more than one piece of material at a time to be heated at the same selected spots, increasing the efficiency of the iron worker by allowing him to pull one spot-heated length after another from the forge as he works and shapes each one.

It is still a further object of the invention to serve as a brazing oven. The small size and sophisticated insulation of the forge allows the operator to work in close proximity to it and observe the heating and brazing process through the burner hole, leaving both hands free to position the material to be brazed. In order to facilitate the brazing process, the burner collar can be rotated to the side and the torch nozzle can be swung upwardly out of the way, allowing the brazing rod to be placed in the forge. The torch can then be swung back into the burner hole to complete the process.

Other and further objects and advantages will appear hereinafter.

BRIEF DESCRIPTION OF THE DRAWINGS

FIG. 1 is a perspective view of the miniature forge, including the torch assembly and optional end plates.

FIG. 3 is a side cut-away view of the miniature forge, showing the burner collar's hinge and hinge pin.

FIG. 4 is a partial cut-away perspective view of the refractory fire brick material lining the miniature forge, showing both the curved cavity located inside the forge body beneath the burner hole and the L-shaped cavity running from end to end.

BRIEF DESCRIPTION OF THE PREFERRED EMBODIMENT

Figure 2:
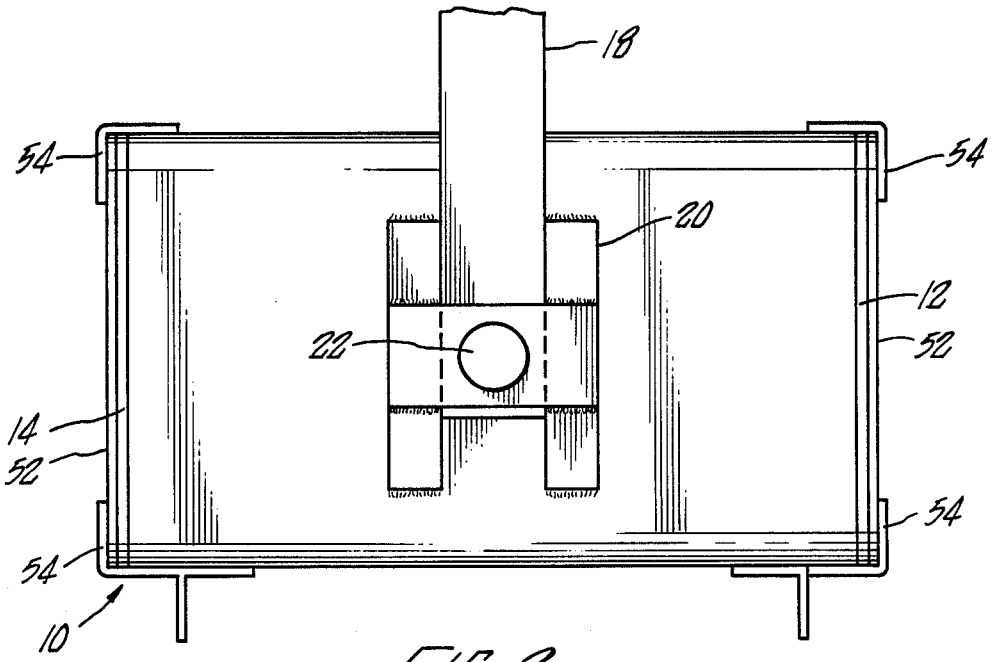
FIG. 2 is a back plan view of the miniature forge, showing the metal bracket and set screw which secure the vertical bar and tank carriage to the forge body.

Turning in detail to the drawings, FIG. 1 illustrates the miniature forge, consisting of a forge body 10 with end plates 12 and 14. A fuel tank carriage 16 is securely connected to a vertical bar 18, which is slidably connected to the rear of the forge body 10 by a metal bracket 20 and set screw 22 as illustrated in FIGS. 2 and 3. In the preferred embodiment, a torch assembly 24 made up of a fuel tank 26, torch 28, and torch tube 30, is securely connected to the fuel tank carriage 16 by a fuel tank strap 32. The torch 28 contains a gas flow valve adjustment knob 34 and an air flow valve adjustment knob 36. The torch 28 is securely connected to the torch tube 30 extending vertically through a burner hole 38 located in the top of the forge body 10. The burner hole 38 is surrounded by a burner collar 40 which helps focus the heat produced by the torch 28 into the interior of the forge body 10.

Referring again to FIG. 3, the burner collar 40 is pivotable away from the burner hole by interaction of hinge 42 with hinge pin 44, in order to facilitate brazing. The forge body 10 contains an L-shaped cavity 46 running from end to end. Referring to FIG. 4, within the L-shaped cavity 46 a curved cavity 48 is located directly below the burner hole 38, in order to facilitate the focusing of heat on the object to be heated. The L-shaped cavity 46 is lined with refractory fire brick material 50, in order to better insulate the area to be heated. As shown in FIG. 3, the edges of the L-shaped cavity 46 are curved inward in order to allow heat to reach the underside of the metal being heated by slightly lifting the metal away from the refractory fire brick material 50 lining the bottom of the forge body 10. The heat is focused on an area roughly $3'' \times 1\frac{1}{2}''$, and the sides of the cavity can be covered with one or two metal plates 52 slidably connected to the forge body 10 by side brackets 54, as shown in FIG. 1, in order to better insulate the interior of the forge body 10 from heat loss.

In the preferred embodiment, the fuel tank 26 can contain commercially available natural petroleum gas, butane, propane or mapp gas for fuel. When fired with mapp gas, the miniature forge can reach a maximum spot heat of 3500° F., yet weighs a total of only 11 pounds.

Figure 5:
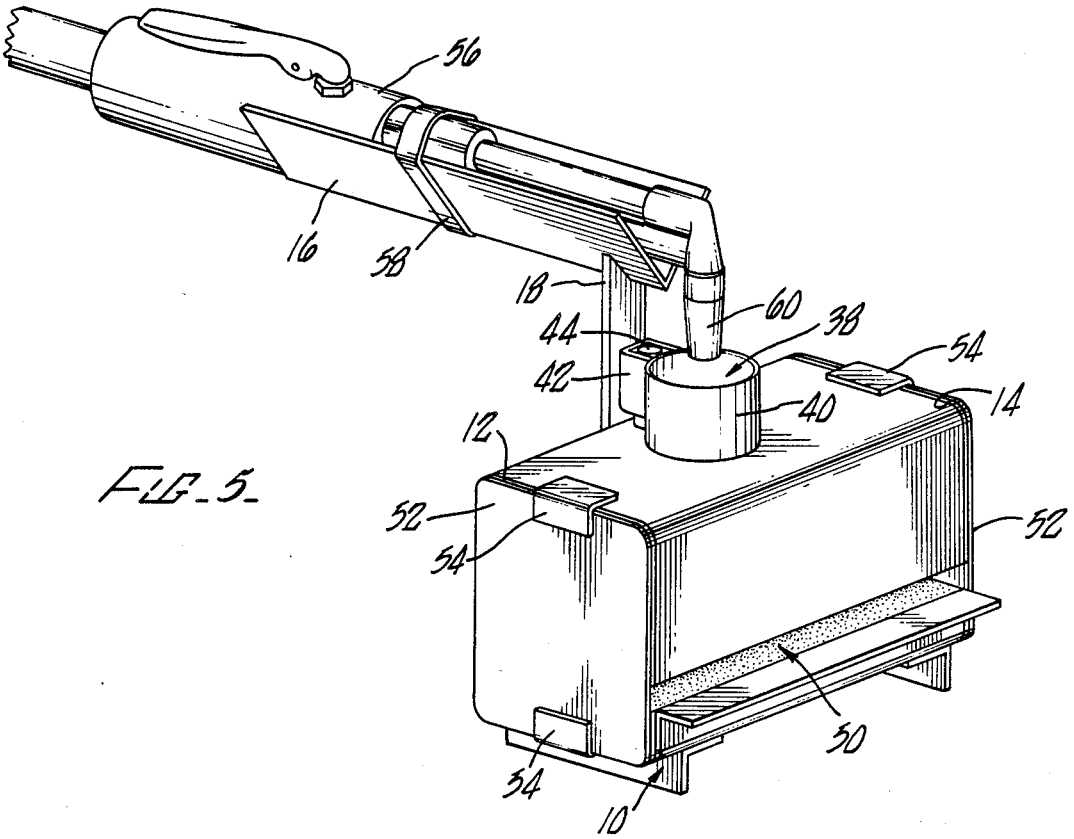
FIG. 5 is a perspective view of the miniature forge, showing a hand-held torch and nozzle replacing the torch and fuel tank shown in FIG. 1.

In a second embodiment of the present invention, the torch assembly 24 is replaced with a hand-held torch 56, secured to the fuel tank carriage 16 by a torch-securing strap 58, as shown in FIG. 5. The nozzle 60 of the hand-held torch 56 is oriented downward through the metal collar 40 into the burner hole 38 located in the top of the forge body 10. In this embodiment the miniature forge gives the user a choice of forge heat or hand-held torch spot heating from a single fuel source.

The miniature forge utilizes the combination of the heat from the torch 28, the adjustable height of its torch tube 30 inside the forge body 10, the burner collar 40 around the burner hole 38, the size and depth of the burner hole 38, and the contour of the curved cavity 48 inside the forge body 10 to increase the efficiency of the heat from the torch 28 by controlling the flow of secondary air to the flame and retaining and directing the heat.

The miniature forge can also be used as a brazing oven. Steel parts can be precisely joined by brazing with brass or copper under the spot heat of the torch 28. The small size and insultion of the forge allow the operator to work close to it and observe the heating and brazing process through the burner hole 38. The burner hole 38 also allows access to the parts being heated for the placement of a brazing rod. The burner collar 40 rotates to the side for this purpose and the torch tube 30 swings up out of the way by rotating the fuel tank 26. The operator can then place the brazing rod precisely on the heated metal and swing the torch back into the burner hole 38 to complete the process. The L-shaped cavity 46 allows parts which are at right angles to each other to be placed in the forge for heating or brazing together, while minimizing the air space to be heated.

Thus, a miniature forge is disclosed which utilizes the advantage of focused, high temperature heat while retaining portability for ease in transportation from workstation to workstation. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed:

1. A miniature forge structure, small in size and light in weight so as to allow portability, comprising:

a forge body;

a fuel tank carriage securely mounted to a vertical bar which is slidably connected to said forge body;

a torch assembly secured to said fuel tank carriage, said torch assembly generating heat vertically downward into the interior of said forge body through a burner hole located in the top of said forge body;

an L-shaped cavity located within said forge body running from end to end which focuses the heat of the torch on a selected area of the object to be heated and shaped, said L-shaped cavity having edges curved inward in order to allow heat to reach the underside of the metal being heated;

a curved cavity contained within said forge body located directly below said burner hole.

2. A forge structure as defined in claim 1, wherein one or both ends of said forge body are covered with metal plates lined with refractory fire brick material slidably supported at one or both ends of said forge body by brackets.

3. A forge structure as defined in claim 1, wherein said forge body contains a collar located above said burner hole which is rotatable to the side.

4. A miniature forge structure, small in size and light in weight so as to allow portability, comprising:

a forge body;

a fuel tank carriage securely mounted to a vertical bar which is slidably connected to said forge body;

a torch assembly secured to said fuel tank carriage, said torch assembly comprising a fuel tank secured to said fuel tank carriage by a fuel tank strap, a torch, and a torch tube oriented vertically downward directing heat into the interior of said forge body through a burner hole located in the top of said forge body;

an L-shaped interior cavity located within said forge body running from end to end which focuses the heat of said torch on a selected area of the object to the heated and shaped, said L-shaped interior cavity having edges curved inward in order to allow heat to reach the underside of the metal to be heated;

one or two metal plates lined with refractory fire brick material covering one or both ends of said forge body slidably supported at one or both ends of said forge body by brackets.

5. A miniature forge structure, small in size and light in weight so as to allow portability, comprising:

a forge body;

a fuel tank carriage securely mounted to a vertical bar which is slidably connected to said forge body;

a torch assembly secured to said fuel tank carriage, said torch assembly comprising a hand-held torch secured to said fuel tank carriage by a torch-securing strap, said hand-held torch having a nozzle directing heat vertically downward through a burner hole located in the top of said forge body;

an L-shaped interior cavity located within said forge body running from end to end which focuses the heat of said torch on a selected area of the object to the heated and shaped, said L-shaped interior cavity having edges curved inward in order to allow heat to reach the underside of the metal to be heated;

one or two metal plates lined with refractory fire brick material covering one or both ends of said forge body slidably supported at one or both ends of said forge body by brackets.

6. A miniature forge structure, small in size and light in weight so as to allow portability, comprising:

a forge body;

a fuel tank carriage securely mounted to a vertical bar which is slidably connected to said forge body;

a torch assembly secured to said fuel tank carriage, said torch assembly comprising a fuel tank secured to said fuel tank carriage by a fuel tank strap, a torch, and a torch tube oriented vertically downward directing heat into the interior of said forge body through a burner hole located in the top of said forge body;

an L-shaped interior cavity located within said forge body running from end to end which focuses the heat of said torch on a selected area of the object to the heated and shaped, said L-shaped interior cavity having edges curved inward in order to allow heat to reach the underside of the metal to be heated;

a collar located above said burner hole which is rotatable to the side.

7. A miniature forge structure, small in size and light in weight so as to allow portability, comprising:

a forge body;

a fuel tank carriage securely mounted to a vertical bar which is slidably connected to said forge body;

a torch assembly secured to said fuel tank carriage, said torch assembly comprising a hand-held torch secured to said fuel tank carriage by a torch-securing strap, said hand-held torch having a nozzle directing heat vertically downward through a burner hole located in the top of said forge body;

an L-shaped interior cavity located within said forge body running from end to end which focuses the heat of said torch on a selected area of the object to the heated and shaped, said L-shaped interior cavity having edges curved inward in order to allow heat to reach the underside of the metal to be heated;

a collar located above said burner hole which is rotatable to the side.

* * * * *